US007614860B2

(12) United States Patent
Yano et al.

(10) Patent No.: US 7,614,860 B2
(45) Date of Patent: Nov. 10, 2009

(54) SCROLL COMPRESSOR

(75) Inventors: Kenji Yano, Tokyo (JP); Toshiyuki Nakamura, Tokyo (JP); Masaaki Sugawa, Tokyo (JP); Kunio Tojo, Tokyo (JP); Fumihiko Ishizono, Tokyo (JP); Masayuki Kakuda, Tokyo (JP); Shin Sekiya, Tokyo (JP); Masahiro Sugihara, Tokyo (JP); Toshihide Koda, Tokyo (JP)

(73) Assignee: Mitsubishi Denki Kabushiki Kaisha, Chiyoda-Ku, Tokyo (JP)

( * ) Notice: Subject to any disclaimer, the term of this patent is extended or adjusted under 35 U.S.C. 154(b) by 15 days.

(21) Appl. No.: 10/594,434

(22) PCT Filed: Dec. 22, 2004

(86) PCT No.: PCT/JP2004/019237

§ 371 (c)(1),
(2), (4) Date: Sep. 26, 2006

(87) PCT Pub. No.: WO2006/067843

PCT Pub. Date: Jun. 29, 2006

(65) Prior Publication Data

US 2008/0219871 A1 Sep. 11, 2008

(51) Int. Cl.
*F04C 18/04* (2006.01)

(52) U.S. Cl. ..... 418/55.1; 418/55.2; 418/60; 418/210; 418/215

(58) Field of Classification Search ..... 418/5, 418/55.1, 55.2, 55.4, 55.6, 55, 60, 142, 88, 418/98, 102, 209, 210, 212, 215, 216
See application file for complete search history.

(56) References Cited

U.S. PATENT DOCUMENTS 3,600,114 A * 8/1971 Dvorak et al. ..... 418/55.2

(Continued)

FOREIGN PATENT DOCUMENTS

JP 59-224493 A 12/1984

(Continued)

*Primary Examiner*—Thomas E Denion
*Assistant Examiner*—Mary A Davis
(74) *Attorney, Agent, or Firm*—Buchanan Ingersoll & Rooney PC

(57) ABSTRACT

A scroll compressor is provided which has favorable assembling property, does not require a thrust bearing, has a bearing structure for bearing a compression section at both sides thereof and has a simple structure of a scroll. The scroll compressor includes a compression section 3 constituted of an orbiting scroll 31 which is provided in a closed container 1, and in which volutes are substantially symmetrically formed on both surfaces of an orbiting base plate 31B, and a main shaft 7 is penetrated through and fixed to a center portion thereof, and a pair of fixed scrolls 33 and 34 that have the main shaft penetrated through and are placed on both the surfaces of the orbiting scroll, and have volutes which correspond to the respective volutes to respectively form compression chambers 32, and a motor 2 which is provided in the closed container and drives the main shaft, a suction pipe 5 which is provided in the closed container, and after a suction gas is introduced into the closed container and cools the motor, causes the gas to be sucked into the compression section, and a discharge pipe 8 which is provided in the closed container and discharges the suction gas compressed by the compression section.

20 Claims, 6 Drawing Sheets

U.S. PATENT DOCUMENTS

| | | | | | |
|---|---|---|---|---|---|
| 5,304,047 | A | * | 4/1994 | Shibamoto | 418/5 |
| 5,449,279 | A | * | 9/1995 | Hill et al. | 418/55.6 |
| 5,775,893 | A | * | 7/1998 | Takao et al. | 418/55.2 |
| 6,149,405 | A | * | 11/2000 | Abe et al. | 418/55.2 |
| 6,167,719 | B1 | * | 1/2001 | Yakumaru et al. | 62/468 |
| 6,193,487 | B1 | * | 2/2001 | Ni | 418/55.2 |
| 6,579,080 | B1 | * | 6/2003 | Spinnler | 418/55.2 |
| 6,682,322 | B2 | * | 1/2004 | Funakoshi et al. | 418/55.1 |
| 6,758,659 | B2 | * | 7/2004 | Ni | 418/55.2 |
| 2002/0150491 | A1 | * | 10/2002 | Takahashi | 418/55.2 |
| 2003/0000238 | A1 | * | 1/2003 | Uchida et al. | 62/323.4 |
| 2008/0038133 | A1 | * | 2/2008 | Sawai et al. | 418/55.2 |
| 2009/0185936 | A1 | * | 7/2009 | Yano et al. | 418/55.4 |

FOREIGN PATENT DOCUMENTS

| | | | | |
|---|---|---|---|---|
| JP | 61268880 | A | * | 11/1986 |
| JP | 04-143475 | | | 5/1992 |
| JP | 05180181 | A | * | 7/1993 |
| JP | 06101666 | A | * | 4/1994 |
| JP | 08-170592 | A | | 7/1996 |
| JP | 08170592 | A | * | 7/1996 |
| JP | 08-326671 | A | | 10/1996 |
| JP | 08326671 | A | * | 12/1996 |
| JP | 10299674 | A | * | 11/1998 |
| JP | 2002235683 | A | * | 8/2002 |
| JP | 2003021084 | A | * | 1/2003 |
| JP | 2003-307187 | A | | 10/2003 |
| JP | 2003307187 | A | * | 10/2003 |

* cited by examiner

SCROLL COMPRESSOR

TECHNICAL FIELD

The present invention relates to a scroll compressor, and more particularly to a scroll compressor having volute teeth on both surfaces of a base plate of an orbiting scroll.

BACKGROUND ART

In a conventional scroll compressor, for example in a case of a vertical type scroll compressor, a compression section is disposed in an upper space in a container, a motor for driving is placed in a lower space, and a lubricating oil storage chamber is formed below the motor. The compression section is formed by combination of an orbiting scroll having an volute tooth formed on only an upper surface of an orbiting scroll base plate, and a fixed scroll opposed to the above volute tooth. A compression chamber is formed by driving the motor via an eccentric shaft connected to a lower surface of the orbiting scroll (for example, refer to Patent Document 1).

There is another type in which volute teeth are formed on both surfaces of an orbiting scroll base plate, compression chambers are formed on an upper and a lower surfaces of the orbiting scroll by opposing fixed scrolls to the respective volute teeth, and the orbiting scroll is driven by a shaft penetrating through each of the scrolls. In this case, the heights of the volute teeth, which are formed on the upper and the lower surfaces of the orbiting scroll, are made different, and an upper compression chamber and a lower compression chamber are connected in series relationship to perform two-stage compression (for example, refer to Patent Document 2).

Patent Document 1: Japanese Patent No. 2743568

Patent Document 2: Japanese Patent Laid-Open No. 08-170592

DISCLOSURE OF THE INVENTION

Problems to be Solved by the Invention

The conventional scroll compressors are constructed as described above. In particular, in Patent Document 1, the compression section is placed in the upper space while the motor is placed in the lower space, so that it is necessary to pass a lead wire connected to the motor through the compression section to lead it to the upper space and connect it to a terminal in the case where the terminal is provided above, and therefore, there is the problem of unfavorable operability.

In the case where the terminal is provided between the compression section and the motor, it is necessary to connect the lead wire to the terminal after the motor is previously fixed to the container by shrink fitting or the like at the time of assembly, and thereafter to fix the compression section to the container. Thus, there is the problem that the assembling operation is complicated.

Further, bearing structure is provided only at the lower position of the compression section, so that there are the problems of one-side abutment of the bearing due to tilt of the shaft, and an increase in associated bearing loss and burning. Further in case the orbiting scroll has the volute tooth only on one side, thrust load occurs due to compression of the operating gas, and therefore, there is the problem of needing a thrust bearing.

In Patent Document 2, the compression chambers are formed on both sides of the orbiting scroll, thrust loads by the compression of the operation gas are cancelled out, and as a result, the load of the thrust bearing is reduced. However, there are some problems of complicating the construction of the scroll, because it is necessary to control the ratio of the height of the volute tooth on the upper surface of the orbiting scroll and the height of the volute tooth on the lower surface so that the minimum closed volume of one compression chamber and the maximum closed volume of the other compression chamber are substantially equal, or to be substantially equal to the ratio of the maximum closed volume and the minimum closed volume of one compression chamber.

The present invention is made to overcome the above described problems, and has an object to provide a scroll compressor that has favorable assembling property, does not require a thrust bearing, has a compression section supported by bearing structure on both sides and is simple in a structure of a scroll.

Means for Solving the Problems

A scroll compressor according to the present invention comprises a compression section provided in a closed container, said compression section including an orbiting scroll having volute teeth formed substantially symmetrically on both surfaces of an orbiting base plate, and a main shaft being penetrated through and fixed at a center portion of said orbiting scroll and a pair of fixed scrolls opposed to said both surfaces of said orbiting scroll, each of said fixed scroll having volute tooth corresponding to each of said volute teeth of said orbiting scroll to respectively form compression chambers; a motor provided in said closed container for driving said main shaft; a suction pipe provided to said closed container for introducing a suction gas into said closed container and for causing said suction gas to be sucked into said compression section after cooling said motor; and a discharge pipe provided to said closed container for discharging said suction gas compressed by said compression section.

Advantages of the Invention

The scroll compressor according to this invention is constructed as described above. Accordingly in case of assembling a vertical type, for example, the compression section is placed in a lower space of the container, the motor is placed in an upper space, and a glass terminal can be provided at an upper end portion above the motor. Therefore, after the compression section and the motor are all fixed inside the container, a lead wire can be finally connected to the terminal, and therefore, assembling property is improved.

Further, the substantially symmetrical volute teeth are formed on both surfaces of the orbiting scroll and the thrust loads caused by compression of an operating gas are cancelled by each other so that a thrust bearing does not have to be provided.

Accordingly, it can be prevented that an increase in abrasion loss and burning due to a broken oil film occurs due to its low circumferential speed and difficulty in forming oil film, that is caused in case of thrust bearing using a gas such as $CO_2$ gas at high pressure with a high load.

Further, since the compression section is supported by bearing structure on both sides thereof, a moment does not occur to the shaft, and therefore, one-side abutment on the bearing due to tilt of the shaft may be prevented, and an associated increase in bearing loss and burning may be prevented.

Further, as described above, the volute teeth on both surfaces of the orbiting scroll are formed to be substantially symmetrical and have substantially the same heights, and therefore, they are simple in structure and can be formed easily.

EXPLANATION OF THE REFERENCE NUMERALS

1 closed container, 2 motor, 3 compression section, 4 lubricating oil storage chamber, 5 suction pipe, 6 glass terminal, 7 main shaft, 8 discharge pipe, 31 orbiting scroll, 32 compression chamber, 33 upper fixed scroll, 34 lower fixed scroll, 35 Oldham joint, 76 oil feed pump, 77 lubricating oil.

BEST MODE FOR CARRYING OUT THE INVENTION

First Embodiment

Figure 1:
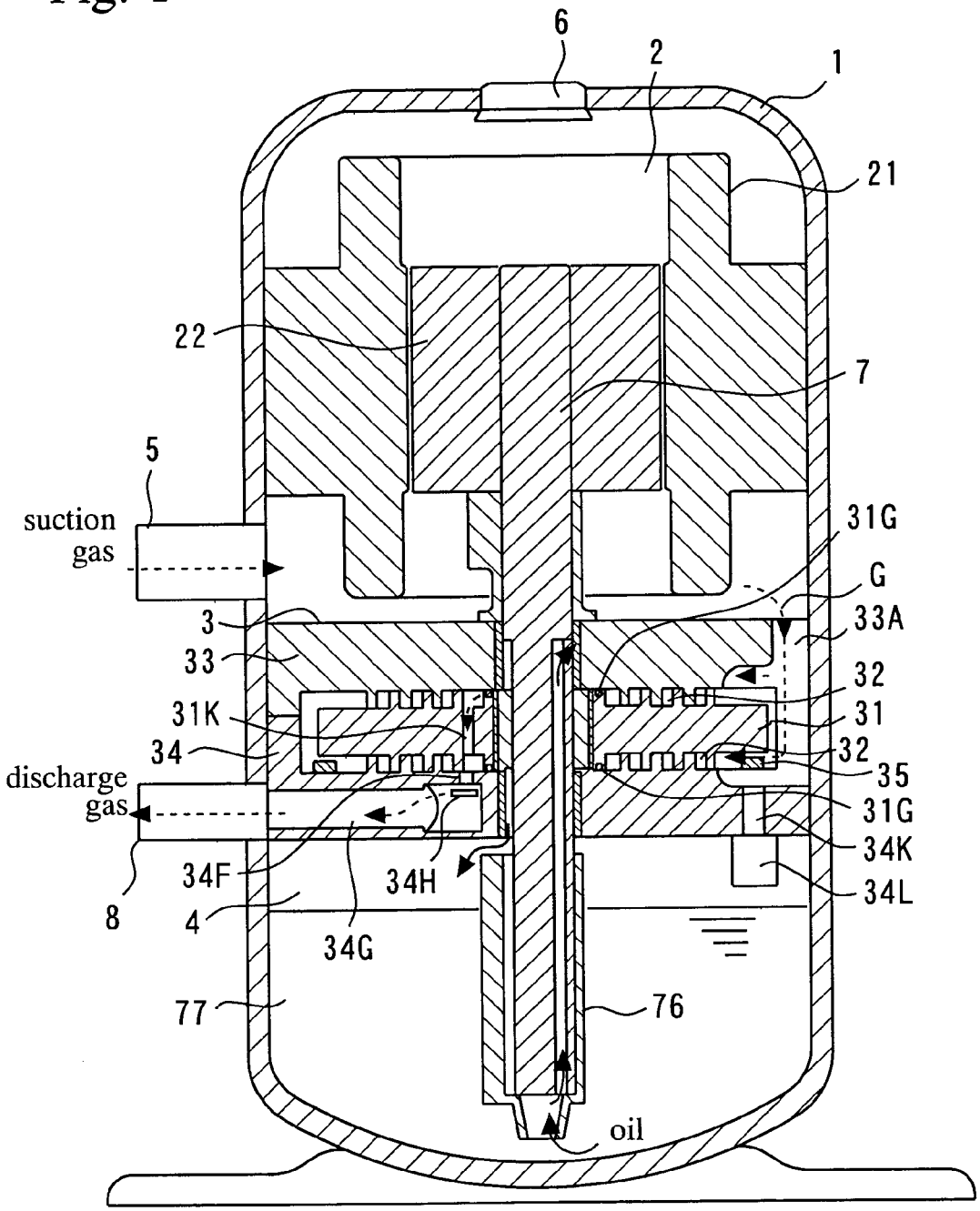
FIG. 1 is a schematic sectional view showing one example of an entire construction in the case of using a vertical container according to a first embodiment.
Figure 2:
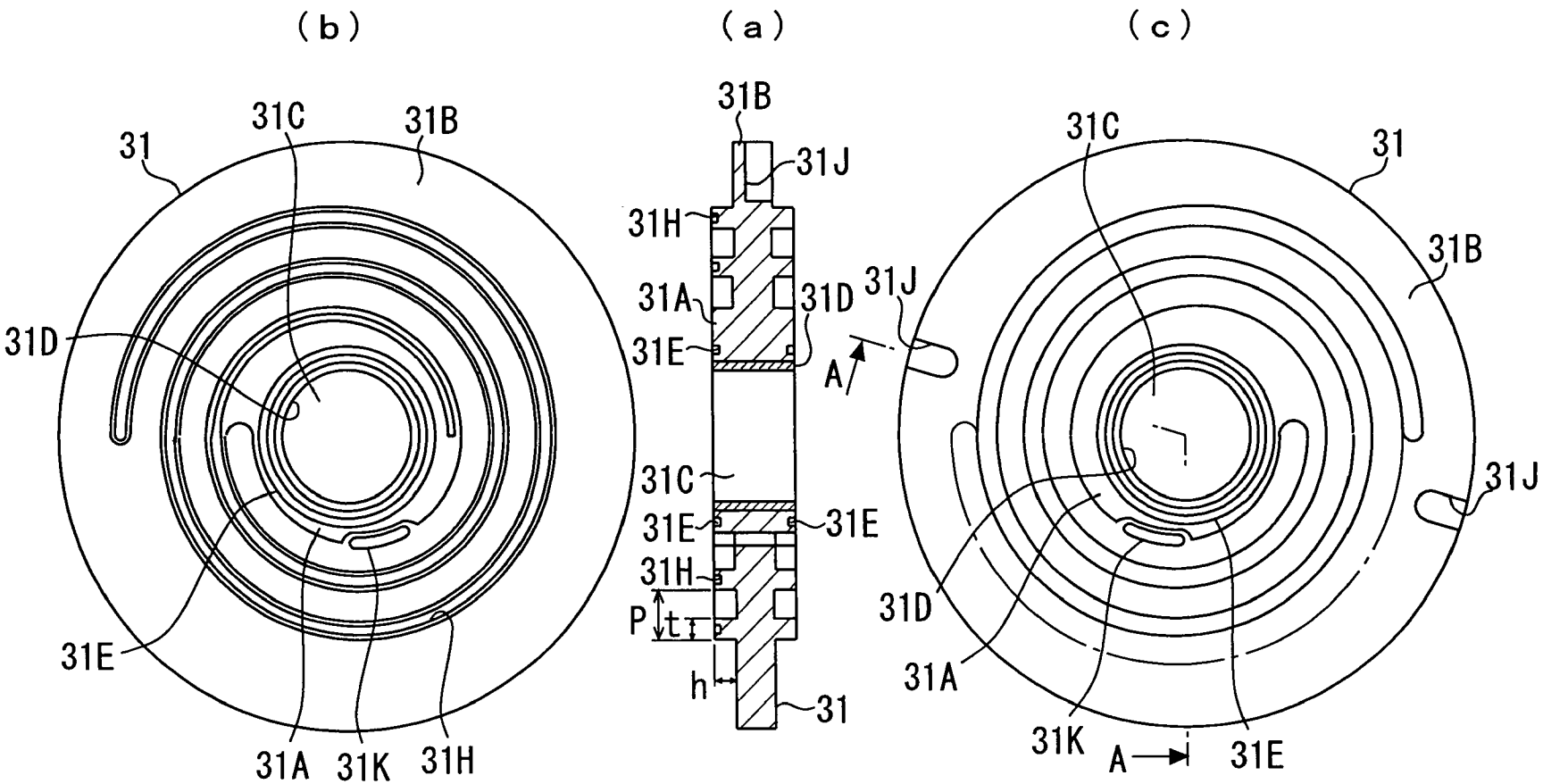
FIG. 2 shows a construction of an orbiting scroll in the first embodiment, (*a*) is a sectional view, (*b*) is a plane view showing a construction of the upper, and (*c*) is a plane view showing a construction of the lower surface.

A first embodiment of this invention will be first described with reference to the drawings. FIG. 1 is a schematic sectional view showing one example of an entire construction using a vertical container according to the first embodiment, FIG. 2 shows a construction of an orbiting scroll in the first embodiment, (*a*) is a sectional view taken along the line A-A in (*c*) that will be described later, and the left side shows an upper surface while the right side shows a lower surface. (*b*) is a plane view showing a construction of the upper surface of the orbiting scroll, and (*c*) is a plane view showing a construction of the lower surface of the same.

Figure 3:
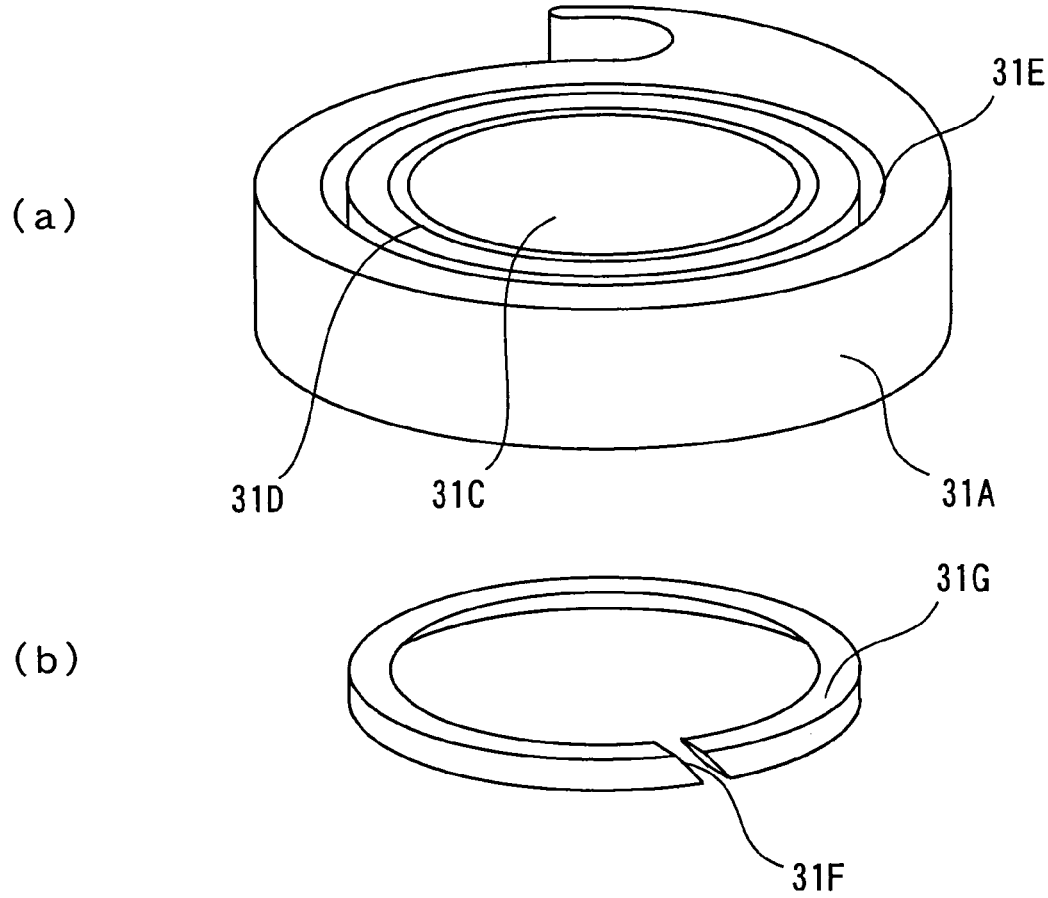
FIG. 3 shows a construction of a core part located in a center portion of the orbiting scroll shown in FIG. 2, (*a*) is a perspective view, (*b*) is a perspective view showing a construction of a seal ring each provided at an upper surface and a lower surface.
Figure 4:
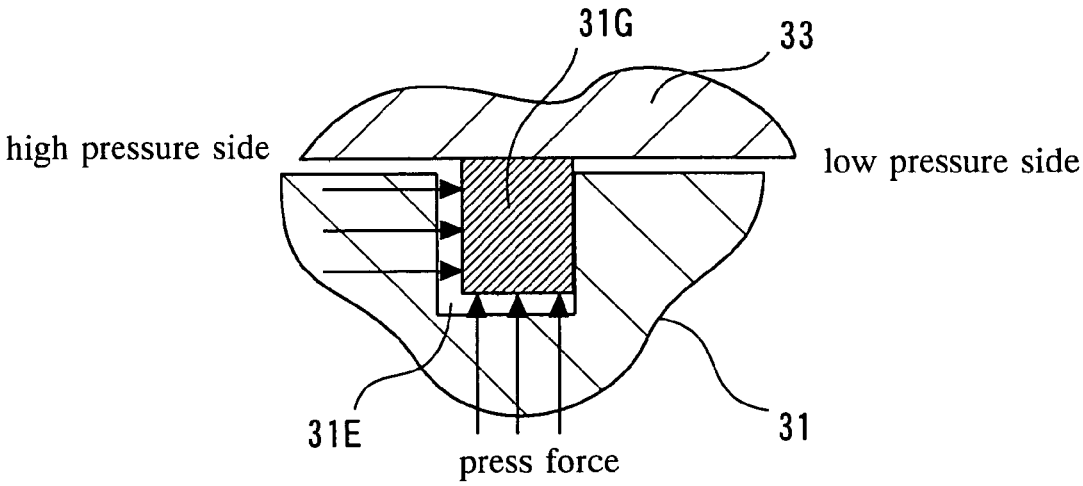
FIG. 4 is an explanatory sectional view for explaining an operational effect of the seal ring in the core part.
Figure 5:
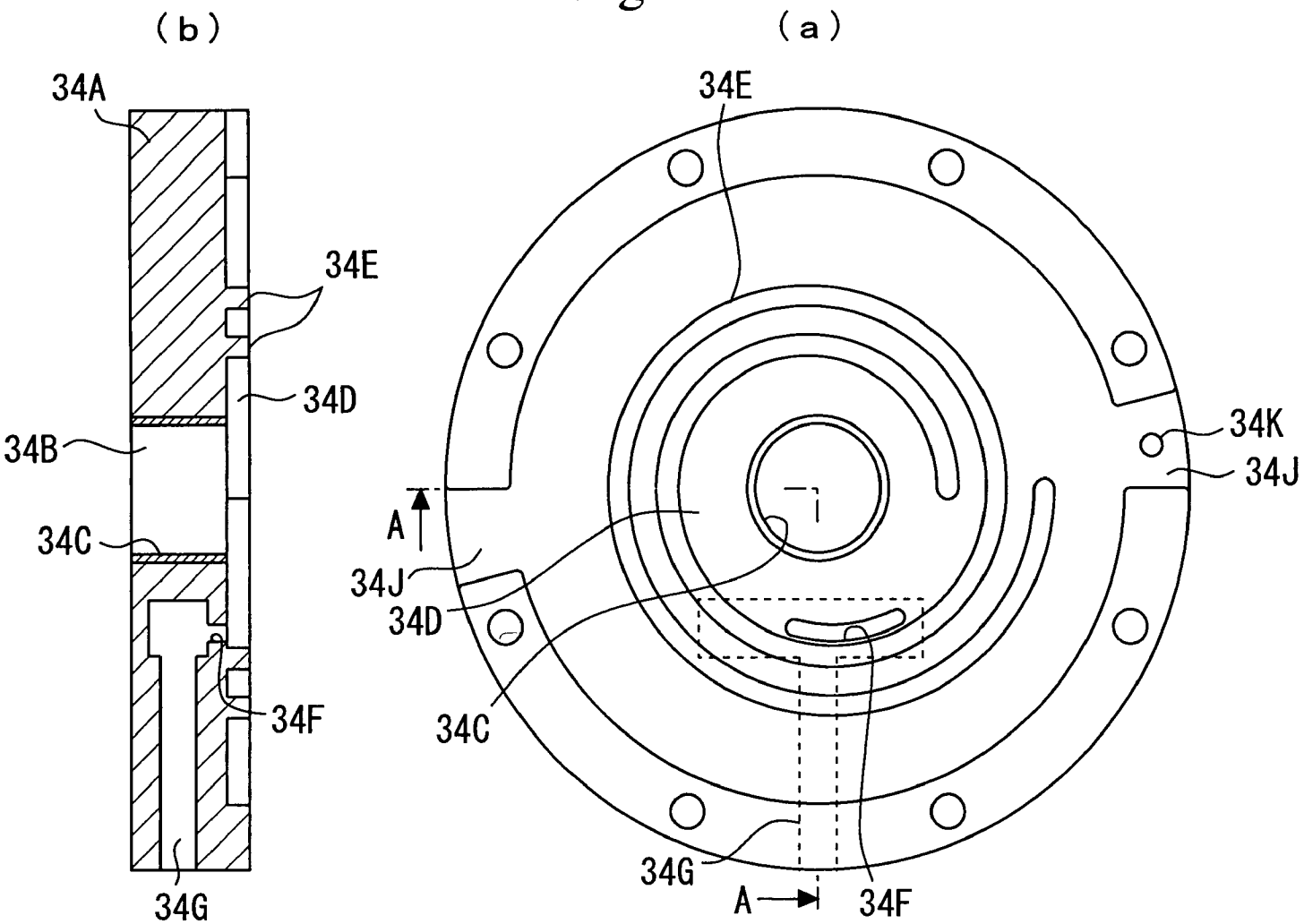
FIG. 5 shows the construction of a fixed scroll at the lower side in FIG. 1 of the fixed scroll s in the first embodiment, (*a*) is a plane view, and (*b*) is a sectional view taken along the line A-A in (*a*)

FIG. 3 shows a construction of a core part located in a center portion of the orbiting scroll shown in FIG. 2, (*a*) is a perspective view showing the shape of the core part, (*b*) is a perspective view showing a construction of a seal ring each provided at an upper surface and a lower surface of the core part, FIG. 4 is an explanatory sectional view for explaining an operational effect of the seal ring in the core part, FIG. 5 shows the construction of a lower side fixed scroll in FIG. 1 in the first embodiment, (*a*) is a plane view, and (*b*) is a sectional view taken along the line A-A in (*a*).

In a scroll compressor of FIG. 1, a motor 2 is placed at an upper portion in a vertical closed container 1, a compression section 3 is placed in a lower portion, and a lubricating oil storage chamber 4 is formed under the compression section 3.

A suction pipe 5 is provided for sucking a suction gas in the closed container 1 at an intermediate portion between the motor 2 and the compression section 3, and a glass terminal 6 is provided at an upper end of the closed container 1 at the upper side of the motor 2.

The motor 2 is constructed by a known stator 21 formed into a ring shape, and a rotor 22 supported to be rotatable in the inside of the stator 21. A main shaft 7 is fixed to the rotor 22, and the main shaft 7 penetrates through the compression section 3 to extend to the lubricating oil storage chamber 4. The relationship between the compression section 3 and the main shaft will be described later.

The compression section 3 includes an orbiting scroll 31 having volute teeth formed on an upper surface and a lower surface of an orbiting base plate in substantially symmetrical shape with substantially same heights, an upper fixed scroll 33 which is disposed to be opposed to the upper surface of the orbiting scroll 31 and has an volute tooth which corresponds to the upper surface volute tooth of the orbiting scroll 31 to form a compression chamber 32, a lower fixed scroll 34 which is disposed to be opposed to the lower surface of the orbiting scroll 31 and has a volute tooth which corresponds to the lower surface volute tooth of the orbiting scroll 31 to form the compression chamber 32, and a known Oldham joint 35 which is placed between the lower fixed scroll 34 and the orbiting scroll 31.

The detailed construction of the orbiting scroll 31 will be described with reference to FIG. 2. As shown in this drawing, the orbiting scroll 31 has a core part 31A which forms a center portion and is constituted of a curved line such as an arc, and a disk-shaped orbiting base plate 31B which extends on the outer periphery of the core part 31A.

As shown in the enlarged view of FIG. 3(*a*), in the core part 31A, a hole 31C, through which a main shaft 7 penetrates, is formed in a center portion, and an orbiting bearing 31D is provided on its inner peripheral wall. A seal ring groove 31E is respectively formed on both surfaces of the core part at an outer side of the orbiting bearing 31D, and a seal ring 31G having an abutment joint 31F as shown in FIG. 3(*b*) is inserted in a respective groove. The details of the seal ring 31G will be described later.

In the core part 31A, a volute tooth is usually formed in an involute curve or an arc outward from its center, and the number of turns of the volute tooth is proportional to the compression ratio of the compressor. In the case of using an HFC gas in air-conditioning for example, the compressor is operated at the compression ratio of 3, so that the number of turns of the volute tooth needs to be three or more. But in the case of using a $CO_2$ gas with a low compression ratio, the compressor is operated at the compression ratio of 2, so that the number of turns of volute tooth becomes two or more, and thus it is possible to reduce the number of turns of the volute tooth by one turn as compared with the case of the HFC gas.

Accordingly, by decreasing the turns of the volute tooth by the amount of one turn or more at the center portion, it becomes possible to form the hole 31C in the center portion of the core part 31A for penetrating the main shaft and to provide the orbiting bearing 31D.

This can be applied for any other case where the low compression ratio is a rated condition as well as the case of $CO_2$ gas.

Two or more turns of a volute tooth are formed respectively on the upper surface and the lower surface of the orbiting base plate 31B in volute curves or arcs substantially symmetrically and substantially in the same height as the core part.

"Substantially symmetrical" means that the thickness t, height h, pitch p and the numbers of turns n of the volute tooth shown in FIG. 2(*a*) are substantially equal, and thereby, the reaction force in the thrust direction which occurs at the time of gas compression is made completely or substantially equal.

Therefore, the thrust forces, which act on the orbiting scroll 31 to upward and downward direction at the time of compression, are cancelled out, and the load in the thrust direction becomes substantially zero, so that the thrust bearing can be eliminated.

Since the thrust forces can be cancelled out by each other, the tooth height of the scroll can be made low, and the volute may be enlarged in the diameter direction into a so-called thin pancake shape, whereby the radial direction force can be made relatively small, and reliability of the journal bearing can be enhanced.

The volute teeth on the upper surface and the lower surface are made substantially symmetrical, but in actual a slight difference is made to occur in the gas pressures of the upper and lower compression chambers for example in order to give rise a slight thrust force downwardly.

As a result, the volute tooth at the lower side of the orbiting scroll 31 is brought into pressure contact with the lower fixed scroll 34, and the volute tooth at the upper side has a gap from the upper fixed scroll 33. Therefore, in the volute tooth of the upper side, a tip seal groove 31H is formed at the upper end surface of the volute tooth as shown in FIGS. 2(*a*) and (*b*), and a tip seal 36 (FIG. 6) is fitted inside of it. On the lower side of the orbiting scroll 31, an Oldham groove 31J corresponding to the Oldham joint 35 is formed at an outermost peripheral portion.

The seal ring 31G provided at the core part 31A is formed as a ring which is rectangular in section as shown in FIG. 3(*b*) and has the abutment joint 31F, and is fitted in the seal ring groove 31E shown in FIG. 3(*a*). This seal ring 31G is placed in the core part 31A to separate the main shaft 7 and the orbiting bearing 31D from the center side of the volute tooth in order to prevent leakage therebetween, since at the time of a compressing operation, the main shaft 7 and the orbiting bearing 31D are at a low pressure, while the center side of the volute tooth is at a high pressure.

The separating action is performed by contact sealing of the seal ring 31G by pressure difference. The seal ring 31G is pressed against the right side wall and to the upper side fixed scroll 33 in the seal ring groove 31E being pressed from the high pressure left side and the lower side as shown by the arrow in FIG. 4.

In this case, sliding contact occurs at the surface of the fixed scroll, but the sliding is at a low circumferential speed of a grinding motion in a small radius as the tip seal, and therefore, friction and sliding loss are small.

In the core part 31A, a communication port 31K is formed at the outer side of the seal ring groove 31E. The communication port 31K penetrates through the orbiting base plate 31B in the vertical direction and combines the gases, which are compressed in the compression chambers on both surfaces of the orbiting scroll 31 as will be described later, to flow to a discharge port of the fixed scroll.

The communication port 31K is formed as a long hole along the seal ring groove 31E, or is formed as a plurality of holes disposed adjacently each other to perform substantially equivalent action as the long hole, and is provided at the position which is not across the compression chambers, and always communicates with the discharge port of the fixed scroll, that will be described later.

Next, the detailed construction of the fixed scroll will be described with reference to FIG. 5. FIG. 5 shows one example of the lower fixed scroll 34.

As shown in FIGS. 5(*a*) and (*b*), a hole 34B is formed in a center portion of a fixed base plate 34A through which the main shaft 7 penetrates, and a main shaft bearing 34C is provided on an inner peripheral surface of this hole.

A recessed portion 34D is formed in the peripheral portion of the main shaft bearing 34C, i.e. the center portion of the fixed base plate 34A, and accommodates the core part 31A of the orbiting scroll 31 and allows the orbiting movement of the orbiting scroll 31. At the outer periphery of the recessed portion 34D, an volute tooth 34E is formed in two or more turns in the same size as the volute tooth of the orbiting scroll 31 in the volute curve or the arc but is rotated 180 degrees in phase.

A discharge port 34F is provided in the recessed portion 34D for discharging the compressed gas without crossing the seal ring 31G of the orbiting scroll.

The discharge port 34F is formed as a long hole along an inner side of the innermost volute tooth of the fixed scroll, or is formed as a plurality of holes disposed adjacently each other to perform substantially the equivalent action with the long hole, and is provided at the position which always communicates with the communication port 31K of the orbiting scroll.

Further, a discharge passage 34G is formed which communicates with the discharge port 34F and flows the compressed gas out of the compressor via a discharge pipe 8 (FIG. 1). A discharge valve 34H is placed at a position opposed to the discharge port 34F in the discharge passage 34G as shown in FIG. 1, and prevents a backflow of the discharge gas.

In an outermost peripheral portion of the lower fixed scroll 34, a suction port 34J is provided as a suction inlet of the suction gas to the lower compression chamber. A discharge port 34K (FIG. 1) is provided which communicates from the suction port 34J to the lubricating oil storage chamber 4 at the lower portion of the closed container. A check valve 34L is provided for the discharge port 34K at the side of the lubricating oil storage chamber 4 as shown in FIG. 1.

The check valve 34L is provided to prevent that oil foams with remaining refrigerant and flows out of the compressor when actuating the compressor. The suction path for suctioning gas into the compression chamber is formed as shown by the broken line arrow G in FIG. 1. The suction path includes the suction port 33A formed in the outermost peripheral portion of the upper fixed scroll 33 and the suction port 34J of the lower fixed scroll 34, and the suction gas is introduced into the respective compression chambers formed both on the upper surface and the lower surface of the orbiting scroll 31.

As shown in FIG. 1, the upper end portion of the main shaft 7 is fitted into the rotor 22 of the motor 2. The main shaft penetrates the through-hole of the upper fixed scroll 33, the through-hole 31C of the orbiting scroll 31 and the through-hole 34B of the lower fixed scroll 34 and is immersed at its lower end portion in the lubricating oil 77 in the lubricating oil storage chamber 4.

Figure 6:
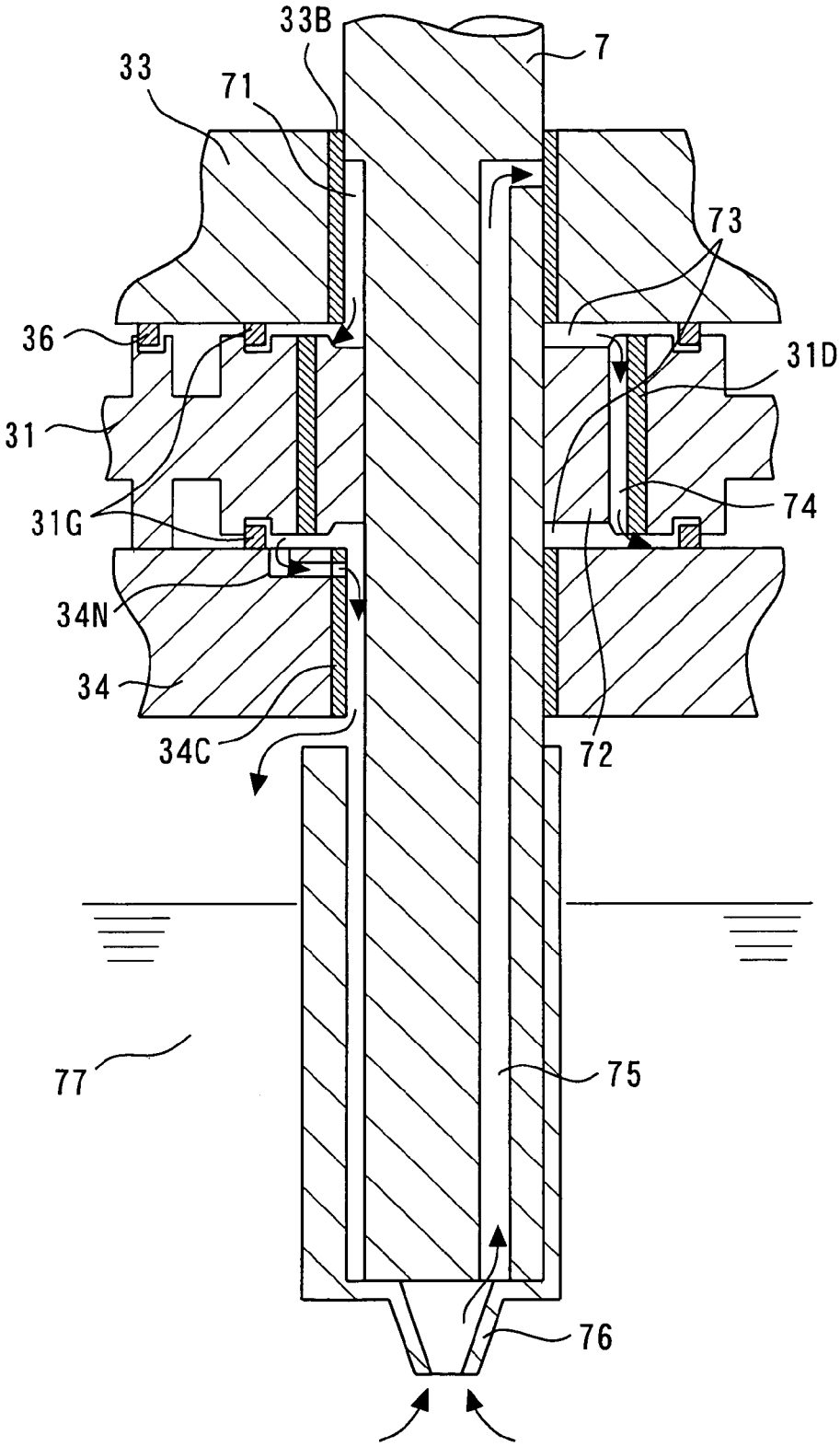
FIG. 6 is an enlarged view of the penetration structure of the main shaft and the compression section and the structure of the lower end portion of the main shaft.

FIG. 6 shows an enlarged view of the penetration structure of the main shaft 7 into the compression section 3 and the structure of the lower end portion of the main shaft 7. Namely, a main shaft bearing 33B is provided between the main shaft 7 and the upper fixed scroll 33. On the surface of the main shaft 7, a notch part 71, having flat surface, is formed from the portion in contact with the main shaft bearing 33B down to the lower end. A slider 72, having an eccentric hole (not shown) with a partially flat surface corresponding to the notch part 71, is fitted to the notch part 71 of the main shaft 7. The outer peripheral surface of the slide 72 is placed to be in contact with the inner peripheral surface of the orbiting bearing 31D of the orbiting scroll 31 shown in FIG. 2. The slider 72, forming an eccentric shaft in combination with the main shaft, drives the orbiting scroll 31 via the orbiting bearing 31D.

On the upper and the lower surfaces of the slider 72, recesses 73 are formed for the paths of lubricating oil. On the surface of the outer peripheral portion of the slider 72, which is in contact with the orbiting bearing 31D, an oil feed groove 74 is formed in the vertical direction and allows the recess 73 on the upper surface to communicate with the recess 73 on the lower surface.

In main shaft 7, an eccentric oil feed hole 75 is formed and extended from the lower end to reach the main shaft bearing 33B of the upper fixed scroll 33. An oil feed pump 76 is provided at the lower end of the main shaft 7 and is immersed in lubricating oil 77 at the lower end of the closed container 1.

Next, an operation of the first embodiment will be explained.

The gas, which is sucked into the closed container 1 from the suction pipe 5, flows into a part of the motor 2. After cooling the motor 2, the gas is taken into the compression chambers 32 on the upper and lower surfaces of the orbiting scroll 31 from the suction port 33A provided in the outer peripheral portion of the upper fixed scroll 33 as shown by the broken line arrow G.

Thereafter, the orbiting scroll 31 performs orbiting movement, without rotating around its own axis, with respect to the upper and the lower fixed scroll s 33 and 34. A pair of crescent compression chambers, which are formed by the known compression principle, reduce their volumes gradually toward the center. The pair of compression chambers finally communicate with each other in the innermost chambers in which the discharge port 34F is present, and flows are guided outside the compressor through the discharge passage 34G.

Figure 7:
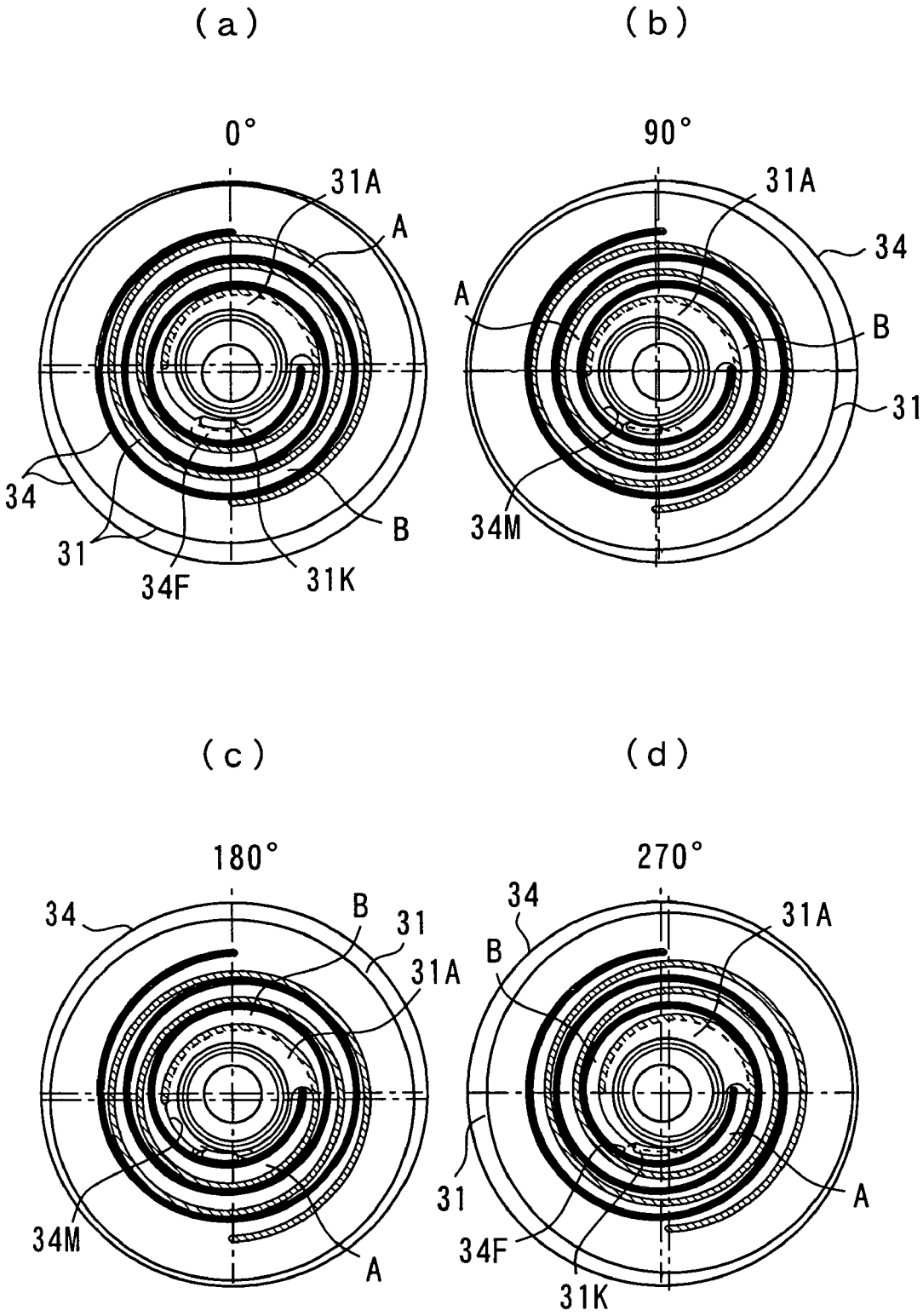
FIG. 7 is an explanatory view to show relation of the orbiting movement of the orbiting scroll and compression chambers.

FIG. 7 shows the process in which a pair of crescent compression chambers, which are formed by the orbiting movement of the orbiting scroll 31, gradually reduce their volumes toward the center. FIG. 7(*a*) shows the state of the orbiting scroll 31 at the orbit angle of 0°. The diagonally slashed portion represents the volute tooth of the orbiting scroll, and the portion painted in black represents the volute tooth of the fixed scroll.

In the state of FIG. 7(*a*), the compression chambers at the outermost periphery complete containing of the gas, and a pair of crescent compression chamber A and B are formed. FIG. 7(*b*) shows the state in which the orbiting scroll 31 orbits by the orbit angle of 90° in the counterclockwise direction.

A pair of compression chamber A and B moves toward the center while reducing in volume.

FIG. 7(*c*) shows the state of the orbit angle of 180°, and FIG. 7(*d*) shows the state of the orbit angle of 270°. In this state, the compression chambers A and B communicate with each other in the innermost chamber in which the discharge port 34F is present, and the gas is discharged from the discharge port 34F.

In FIG. 7, the shape of the core part 31A of the orbiting scroll 31 forms the volute curve up to the portion shown by the broken line, and forms one border of the compression chamber B. The center side from this becomes the curve of the core part and forms the innermost chamber that does not contribute to compression, and forms a border surface in combination with the inner surface of the volute tooth of the fixed scroll 34.

The discharge port 34F is provided in the innermost chamber which does not contribute to compression, and is positioned not to cross the aforementioned seal ring 31G during the compression step, so that a sufficient flow passage is ensured. For that purpose, the curve of the core part and the curve of the inner surface of the volute tooth of the fixed scroll are formed to secure a clearance space in order not to block the discharge port 34F completely with the core part 31A during the compression step.

In a type of compressor in which an integrated volume ratio is fixed as a scroll compressor, compression insufficiency loss occurs in the final discharge step when the operation is performed with a higher compression ratio than a set compression ratio. The compression insufficiency loss means that the pressure in the innermost chamber is higher than the pressure of the compression chambers A and B, when the innermost chamber and the compression chambers A and B communicate each other as in FIG. 7(*d*) for example. Then, backflow occurs to the compression chambers A and B from the innermost chamber, and causes loss of the compression power.

Therefore, the top clearance volume is restrained to a minimum, which is defined as the volume upstream of the discharge valve 34H, namely the total sum of the innermost chamber, the discharge port 34F and the communication port 31K. Further, a little relief portion 34M is formed in the core part 31A. The relief portion 34M is to secure a flow passage by expanding width with reduced radius of the curvature.

Next, oil feed will be described. As shown in FIG. 6, the lubricating oil 77, which is sucked as shown by the arrow from the lower end of the main shaft 7 by the oil feed pump 76, is sucked up through the oil feed hole 75 in the main shaft 7 as shown by the arrow, and is fed into the main shaft bearing 33B of the upper fixed scroll 33.

Thereafter, the lubricating oil passes the flat portion of the notch part 71 formed on the main shaft to flow down and, via the recess 73 formed on the upper surface of the slider 72, flows into the oil feed groove 74 which is formed in the vertical direction on the outer peripheral surface of the slider 72 to lubricate the slider 72.

The oil, which flowed down in the oil feed groove 74, passes via the recess 73 on the lower surface of the slider, and passes through a return hole 34N formed in the lower fixed scroll 34, and flows towards the center direction of the main shaft, and flows down in the notch part 71 of the main shaft 7 again while feeding oil to the main shaft bearing 34C of the lower fixed scroll 34, and is discharged outside the main shaft from the lower end portion of the main shaft bearing 34C as shown by the arrow, and returns to the lubricating oil storage chamber 4.

As described above, the oil feed path forms a circulating closed loop from feeding through discharging without directly contacting the flow of the suction gas.

Accordingly, it is prevented that the oil is caught by the suction gas and flows out of the compressor.

The first embodiment is constructed as above, and therefore the compressor is suitable, for example, in a case where a heat exchanger volume of an air conditioner is made large for energy saving, in a case where the apparatus is tuned to perform a normal operation with a low compression ratio as an ice thermal storage system for peak-cut and load-leveling, and in a case where a refrigerant such as a $CO_2$ gas is used and normal operation is performed at a low compression ratio for air conditioning operation. A high efficiency of the apparatus can be maintained.

INDUSTRIAL APPLICABILITY

This invention can be favorably utilized in an air conditioner or an ice heat storage system that are tuned to be normally operated with a low compression ratio, or in an air conditioner using a refrigerant such as a $CO_2$ gas and having a low compression ratio at normal operation.

The invention claimed is:

1. A scroll compressor comprising:

a compression section provided in a closed container, said compression section including:

an orbiting scroll having a groove and volute teeth formed substantially symmetrically on both surfaces of an orbiting base plate, and a main shaft being penetrated through and fixed at a center portion of said orbiting scroll;

seal means provided at least partially inside the groove of the orbiting scroll; and a pair of fixed scrolls opposed to said both surfaces of said orbiting base plate, each of said fixed scrolls having a volute tooth corresponding to each of said volute teeth of said orbiting scroll to respectively form compression chambers;

a motor provided in said closed container for driving said main shaft;

a suction pipe provided to said closed container for introducing a suction gas into said closed container and for causing said suction gas to be sucked into said compression section after cooling said motor; and a discharge pipe provided to said closed container for discharging said suction gas compressed by said compression section, wherein the seal means is provided for sealing the compression chambers formed between the orbiting scroll and the fixed scrolls from an orbiting bearing provided at a main shaft side of the orbiting scroll and from main shaft bearings provided between the fixed scrolls and the main shaft.

2. The scroll compressor according to claim 1, wherein said closed container is vertically disposed, said compression section is disposed at a lower portion in said closed container, said motor is disposed at an upper portion in said closed container, a lubricating oil storage chamber is formed in said closed container below said compression section, and an oil feed pump for sucking up lubricating oil from said lubricating oil storage chamber is disposed at a lower end of said main shaft.

3. The scroll compressor according to claim 2, wherein said closed container is partitioned by said compression section into a motor housing part and the lubricating oil storage chamber, said suction pipe is provided at said motor housing part, said discharge pipe is provided at said compression section, and an oil feed path is formed, said oil feed path communicating from said oil feed pump, running through inside of said main shaft, opening at an upper fixed scroll main shaft bearing, passing through an orbiting scroll main shaft bearing, passing through a lower fixed scroll main shaft bearing and reaching said lubricating oil storage chamber.

4. The scroll compressor according to claim 3, wherein a passage is provided in said compression section for communicating between said motor housing part and said lubricating oil storage chamber, and a check valve, for preventing backflow of said lubricating oil, is provided at an opening of said passage at said lubricating oil storage chamber.

5. The scroll compressor according to claim 3, wherein a suction port, for communicating between said motor housing part and said compression chamber, is provided at an outer peripheral portion of said upper fixed scroll of said compression section.

6. The scroll compressor according to claim 1, wherein said suction pipe is provided to said closed container at said compression section, and a glass terminal is provided at an upper end portion of said closed container.

7. The scroll compressor according to claim 1, wherein said seal means is provided at a core part of said orbiting scroll at surfaces thereof facing to said fixed scrolls.

8. The scroll compressor according to claim 7, wherein a discharge port of a compressed gas is provided in a center portion of said fixed scroll at a spot which is not across said seal means.

9. The scroll compressor according to claim 8, wherein said discharge port is provided at only one of the fixed scrolls, and a communication port is provided penetrating through the orbiting base plate at said core part of said orbiting scroll and outside said seal means, and said communication port is not across said compression chamber and always communicates with said discharge port.

10. The scroll compressor according to claim 9, wherein said discharge port and said communication port are formed respectively as a long hole or by a plurality of holes adjacent to each other.

11. The scroll compressor according to claim 1, wherein said suction gas is a $CO_2$ gas.

12. The scroll compressor according to claim 1, wherein the seal means is actuated by a pressure exerted on the seal means by a lubricating oil.

13. The scroll compressor according to claim 12, wherein the pressure is exerted on two surfaces of the seal means.

14. A scroll compressor comprising:

a compression section provided in a closed container, said compression section including:

an orbiting scroll having a groove and volute teeth formed substantially symmetrically on both surfaces of an orbiting base plate, and a main shaft being penetrated through and fixed at a center portion of said orbiting scroll;

seal means provided at least partially inside the groove of the orbiting scroll; and a pair of fixed scrolls opposed to said both surfaces of said orbiting base plate, each fixed scroll having volute teeth corresponding to each of said volute teeth of said orbiting scroll to respectively form compression chambers; and a motor provided in said closed container for driving said main shaft, wherein the seal means is provided for sealing the compression chambers formed between the orbiting scroll and the fixed scrolls from an orbiting bearing provided at a main shaft side of the orbiting scroll and from main shaft bearings provided between the fixed scrolls and the main shaft, and wherein each of said orbiting scroll and fixed scrolls has more than two turns of volute teeth formed toward the periphery of said main shaft.

15. The scroll compressor according to claim 14, wherein said orbiting scroll is composed of a core part and an volute part, wherein said core part has a orbiting bearing in a center portion thereof and is formed in a curved shape such as an arc, and said volute part is formed at periphery of said core part and has a continuous volute teeth formed in a volute curve in substantially the same height as said core part.

16. The scroll compressor according to claim 15, wherein said fixed scroll has a recess in a center portion and an volute tooth formed on the outer periphery of said recess, said recess accommodating said core part of said orbiting scroll, said volute tooth, being the same in size as a volute tooth of said orbiting scroll formed in an volute curve, being rotated 180 degrees in phase.

17. The scroll compressor according to claim 15, wherein an innermost chamber of said core part of said orbiting scroll does not contribute to compression.

18. The scroll compressor according to claim 15, wherein a pair of said compression chambers is formed by a combination of said orbiting scroll and said fixed scroll, and a relief portion, for causing said pair of compression chambers to communicate with each other during part of a compression operation, is provided in said core part of said orbiting scroll.

19. The scroll compressor according to claim 14, wherein said scroll compressor uses a suction gas for performing an operation with a compression ratio of 2.

20. The scroll compressor according to claim 14, wherein said scroll compressor uses a $CO_2$ gas as a suction gas for performing a compression operation.

* * * * *